US011508300B2

(12) United States Patent
Homura

(10) Patent No.: US 11,508,300 B2
(45) Date of Patent: Nov. 22, 2022

(54) DISPLAY DEVICE

(71) Applicant: JOLED INC., Tokyo (JP)

(72) Inventor: Shigeo Homura, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/002,157

(22) Filed: Aug. 25, 2020

(65) Prior Publication Data

US 2021/0104193 A1 Apr. 8, 2021

(30) Foreign Application Priority Data

Oct. 3, 2019 (JP) ..... JP2019-182968

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01)

(58) Field of Classification Search
CPC ..... G09G 3/3233; G09G 3/3291
See application file for complete search history.

(56) References Cited

U.S. PATENT DOCUMENTS

2016/0005384 A1* 1/2016 Yoon ..... G09G 3/3291 345/82
2016/0210898 A1 7/2016 Tsuge et al.
2019/0005889 A1 1/2019 Kwon et al.

FOREIGN PATENT DOCUMENTS

WO 2015/033496 3/2015

OTHER PUBLICATIONS

Partial European Search Report from European Patent Office (EPO) in European Patent Appl. No. 20192362.0, dated Jan. 25, 2021.

* cited by examiner

*Primary Examiner* — Stacy Khoo
(74) *Attorney, Agent, or Firm* — Greenblum & Bernstein, P.L.C.

(57) ABSTRACT

A display device includes: pixels arranged in a matrix; a plurality of write signal lines for selecting a pixel row to which a data voltage is to be written; a gate driver that supplies a gate signal; a plurality of data signal lines for writing the data voltage; a data driver that supplies the data voltage; a data selector circuit that supplies, per at least one data signal line by time division, the data voltage; and a controller. Each of the pixels includes a light-emitting element, a capacitor element, and a drive transistor that supplies a current in accordance with the voltage held by the capacitor element to the light-emitting element. The controller causes the gate driver and the data driver to perform an initialization operation on pixels in a second pixel row after a period during which a write operation is performed on pixels in a first pixel row.

9 Claims, 11 Drawing Sheets

DISPLAY DEVICE

CROSS REFERENCE TO RELATED APPLICATION

The present application is based on and claims priority of Japanese Patent Application No. 2019-182968 filed on Oct. 3, 2019. The entire disclosure of the above-identified application, including the specification, drawings and claims is incorporated herein by reference in its entirety.

FIELD

The present disclosure relates to display devices using organic electroluminescent (EL) elements.

BACKGROUND

Conventionally, display devices using light-emitting elements such as organic EL elements have been developed. Such a display device includes a plurality of pixels arranged in a matrix, and each of the plurality of pixels has an organic EL element and a drive transistor that supplies the organic EL element with a current in accordance with a video signal that is input to the display device. With the use of the display device, the drive transistor deteriorates and a threshold voltage shifts. When such threshold voltage shifting occurs in the drive transistor, it is not possible to supply a current corresponding to a video signal to the organic EL element. Accordingly, it is not possible for the organic EL element to emit light with luminance corresponding to the video signal. In order to overcome a problem as described above, techniques of compensating a threshold voltage have been proposed (Patent Literature (PTL) 1).

CITATION LIST

Patent Literature

PTL 1: International Publication No. WO2015/033496

SUMMARY

Technical Problem

In the display device disclosed in PTL 1, however, uneven brightness may occur in some cases.

Hence, the present disclosure is conceived in view of the above-described problem and has an object to reduce uneven brightness in a display device using light-emitting elements.

Solution to Problem

In order to achieve the aforementioned object, a display device according to one aspect of the present disclosure includes: a plurality of pixels arranged in a matrix in rows and columns; a plurality of gate signal lines, each of which is disposed for a different one of pixel rows, for selecting a pixel row to which a data voltage for image data is to be written, the pixel rows including a first pixel row and a second pixel row that are mutually different and are included in the plurality of pixels; a gate driver that supplies a gate signal to the plurality of gate signal lines; a plurality of data signal lines, each of which is disposed for a different one of pixel columns, for writing the data voltage; a data driver that supplies the data voltage to the plurality of data signal lines; a data selector circuit that supplies, per at least one data signal line by time division, the data voltage from the data driver, the at least one data signal line being included in the plurality of data signal lines; and a controller that controls the gate driver and the data driver. Each of the plurality of pixels includes: a light-emitting element including a first electrode and a second electrode; a capacitor element for holding a voltage; and a drive transistor that is connected to the first electrode of the light-emitting element and supplies a current in accordance with the voltage held by the capacitor element to the light-emitting element. The controller causes the gate driver and the data driver to perform an initialization operation of initializing a potential of the first electrode of the light-emitting element in each of pixels included in the second pixel row, after a period during which a write operation of writing the data voltage to pixels included in the first pixel row is performed. In order to achieve the aforementioned object, a display device according to one aspect of the present disclosure includes: a plurality of pixels arranged in a matrix in rows and columns; a plurality of gate signal lines, each of which is disposed for a different one of pixel rows, for selecting a pixel row to which a data voltage for image data is to be written, the pixel rows including a first pixel row and a second pixel row that are mutually different and are included in the plurality of pixels; a gate driver that supplies a gate signal to the plurality of gate signal lines; a plurality of data signal lines, each of which is disposed for a different one of pixel columns, for writing a data voltage for image data; a data driver that supplies the data voltage to the plurality of data signal lines; a data selector circuit that supplies, per at least one data signal line by time division, the data voltage from the data driver, the at least one data signal line being included in the plurality of data signal lines; and a controller that controls the gate driver and the data driver. Each of the plurality of pixels includes: a light-emitting element that includes a first electrode and a second electrode; a capacitor element for holding a voltage; a drive transistor that is connected to the first electrode of the light-emitting element and supplies a current in accordance with the voltage held by the capacitor element to the light-emitting element, a reference power line to which a reference voltage is applied; a reference transistor connected between the reference power line and a gate electrode of the drive transistor; and a write transistor connected between the gate electrode of the drive transistor and the data signal line connected to the pixel. The controller causes the gate driver and the data driver to (i) perform an initialization operation of initializing a potential of the first electrode of the light-emitting element in each of pixels included in the second pixel row in a first period during which a write operation of writing the data voltage to pixels included in the first pixel row is performed and (ii) turn on the reference transistor before a start point of the initialization operation.

Advantageous Effects

With the display device according to one aspect of the present disclosure, it is possible to reduce uneven brightness in a display device using light-emitting elements.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS (Knowledge Forming Basis of the Present Disclosure)

Knowledge forming the basis of the present disclosure will be described before the description of embodiments according to the present disclosure.

Figure 1:
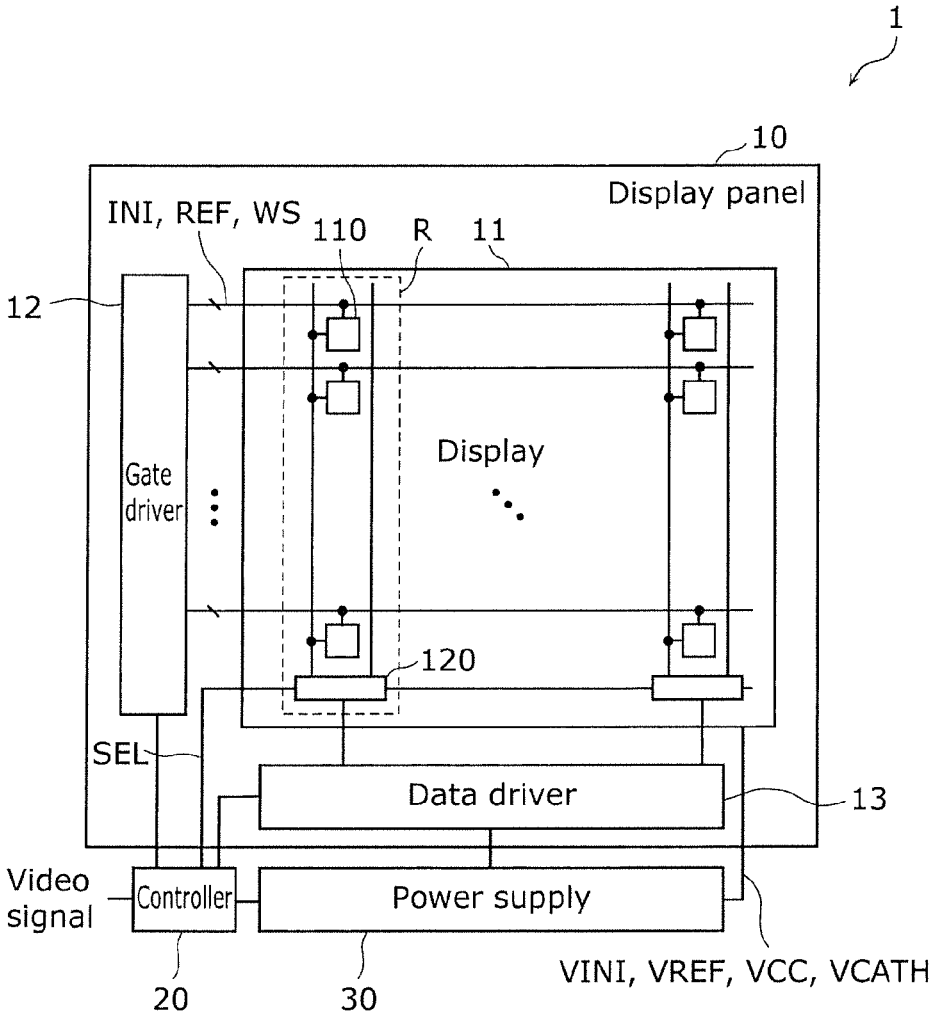
FIG. 1 is one example of a functional configuration of a display device according to Embodiment 1.

In a display device, a plurality of data signal lines, each of which is disposed for a different one of pixel columns in a plurality of pixels, for writing a data voltage (data signal) for image data are provided. The plurality of data signal lines are connected to a data driver for supplying a data signal for image data, and the data signal is applied to the data signal lines. In such a display device, a data selector circuit (e.g., data selector circuit 120 that is illustrated in FIG. 1 and is to be described later) that exclusively switches, from one to another, a connection between the data driver and each of at least two data signal lines is provided in some cases. A data signal that is output from the data selector circuit is output to each of at least two data signal lines by time division. In other words, the data signal from the data driver is input to each pixel column (each pixel) by time division.

The inventor of the present disclosure has found out that uneven brightness occurs when a threshold compensation operation of compensating a threshold voltage, as disclosed in PLT 1, is performed in a display device including such a data selector circuit. Specifically, the inventor has discovered that uneven brightness occurs due to an initialization operation, which is performed before the threshold compensation operation, of initializing the potential of a first electrode (e.g., anode) of an organic EL element included in a pixel.

In view of this, the present disclosure has an object to reduce the uneven brightness as described above in a display device including a data selector circuit. The uneven brightness will be described later in greater detail.

The following describes embodiments according to one or more aspects of the present disclosure with reference to the drawings. Note that the embodiments described below each show a concrete example of the present disclosure. Accordingly, the numerical values, shapes, materials, elements, the arrangement and connection of the elements, etc. indicated in the following embodiments are mere examples, and therefore do not intend to limit the scope of the present disclosure. Therefore, among elements in the following embodiments, those not recited in any one of the independent claims for the present disclosure are described as optional elements.

The drawings are presented schematically and are not necessarily precise illustrations. In addition, substantially like elements are assigned with like reference signs in the drawings, and duplicate description is omitted or simplified.

In the present description, a numerical value and a numerical range are each not representing only a strict meaning of the numerical value or range, but implying that a substantially same range, e.g., a range that includes even a difference as small as few percentages is included in the value or range.

Embodiment 1

1-1. Configuration of Display Device

Figure 2:
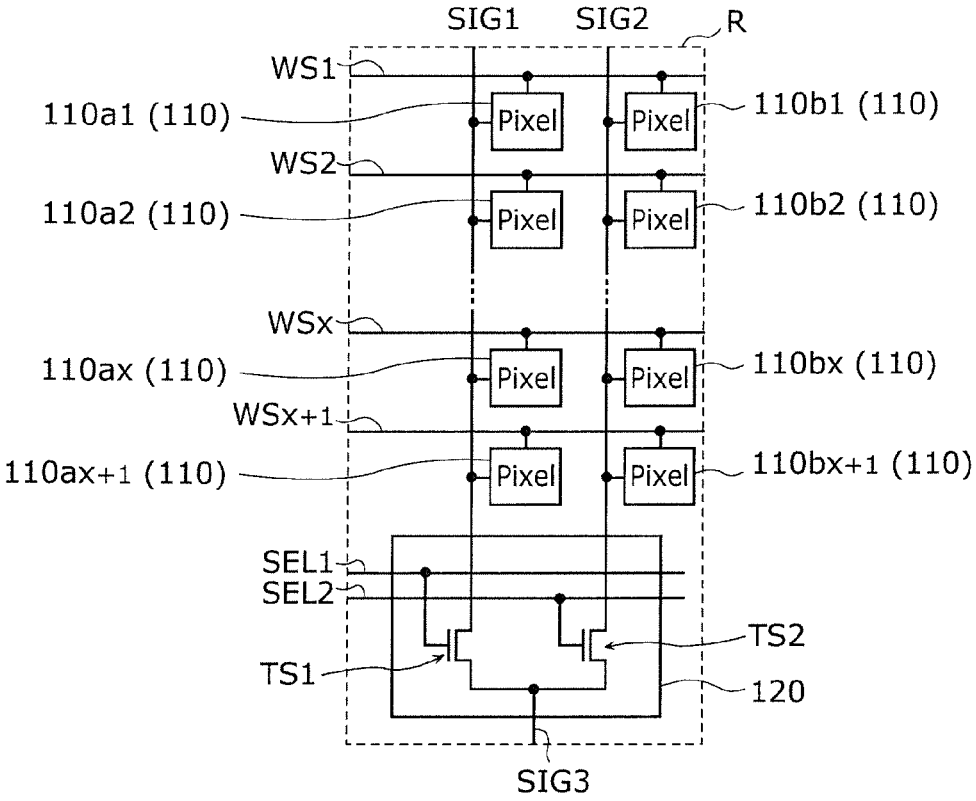
FIG. 2 is a diagram illustrating a magnified view of a region enclosed by a dashed line and illustrated in FIG. 1.

A configuration of a display device according to this embodiment will be described with reference to FIG. 1 through FIG. 3. FIG. 1 is a block diagram illustrating one example of a functional configuration of display device 1 according to this embodiment. FIG. 2 is a diagram illustrating a magnified view of region R enclosed by a dashed line and illustrated in FIG. 1.

Display device 1 includes display panel 10, controller 20, and power supply 30, as illustrated in FIG. 1. Display panel 10 includes display 11, gate driver 12, and data driver 13.

Display 11 includes a plurality of pixels 110 arranged in a matrix in rows and columns, and data selector circuit 120. A control signal line that is commonly connected to pixels 110 arranged in the same row is disposed for a different one of rows in the matrix, and a data signal line that is commonly connected to pixels 110 arranged in the same column is disposed for a different one of columns in the matrix.

Data selector circuit 120 has a function to select either first signal line SIG1 or second signal line SIG2 and exclusively supplies a data signal from data driver 13 to selected first signal line SIG1 or second signal line SIG2, as illustrated in FIG. 2. Data selector circuit 120 includes selector transistors TS1 and TS2 that are selectors each disposed for a different one of pixel columns. By selector transistors TS1 and TS2 being controlled, data selector circuit 120 exclusively supplies a data signal from data driver 13 to either first signal line SIG1 or second signal line SIG2. Specifically, selector transistor TS1 is controlled by first selector control line SEL1 and selector transistor TS2 is controlled by second selector control line SEL2. First signal line SIG1 and second signal line SIG2 are each one example of a data signal line.

When the level of a signal that is input to first selector control line SEL1 and write signal line WS1 becomes high, for example, a voltage corresponding to a data signal is held in pixel 110*a*1 (pixel). When the level of a signal that is input to second selector control line SEL2 and write signal line WS1 becomes high, for example, a voltage corresponding to a data signal is held in pixel 110*b*1. In this way, an operation of holding a voltage corresponding to a data signal is performed by time division on at least two pixels 110 among the plurality of pixels 110 arranged in the same row.

Although it is described with reference to FIG. 2 that data selector circuit 120 exclusively switches between two data signal lines, data selector circuit 120 may have a function to supply a data signal to at least one data signal line selected from among at least three data signal lines.

Each of first signal line SIG1 and second signal line SIG2 has a function to supply a data signal and is connected to pixels 110 that belong to a different one of pixel columns which includes at least one pixel 110. A data signal (voltage) corresponding to a current supplied to organic EL element (organic EL element 111 in FIG. 3) is applied to each of first signal line SIG1 and second signal line SIG2. First signal line SIG1 and second signal line SIG2 are each connected to data selector circuit 120.

Third signal line SIG3 connects data selector circuit 120 and data driver 13.

It is to be noted that a pixel row including pixel 110*a*1 and pixel 110*b*1 is one example of a first pixel row, and a pixel row including pixel 110*a*2 and pixel 110*b*2 is one example of a third pixel row. Moreover, a pixel row including pixel 110*ax* and pixel 110*bx* is one example of a second pixel row, and a pixel row including pixel 110*ax*+1 and pixel 110*bx*+1 is one example of a fourth pixel row.

The third pixel row is a pixel row on which a write operation is performed after a write operation is performed on the first pixel row, and is a pixel row placed in a location that is one pixel row down from the first pixel row, for example. The second pixel row is a pixel row on which an initialization operation is performed when the write operation is performed on the first pixel row, and is a pixel row placed in a location that is some pixel rows down from the first pixel row, for example. The fourth pixel row is a pixel row on which an initialization operation is performed when the write operation is performed on the third pixel row, and is a pixel row placed in a location that is some pixel rows down from the third pixel row, for example. The fourth pixel row is a pixel row placed in a location that is one pixel row down from the second pixel row, for example.

Referring back to FIG. 1, controller 20 is a circuit that controls display panel 10, receives a video signal from outside, and controls gate driver 12 and data driver 13 so that an image indicated by the video signal is displayed on display 11. Controller 20 supplies a control signal for controlling the operation of data selector circuit 120 to data selector circuit 120 via selector control line SEL so that a data signal from data driver 13 is supplied to either first signal line SIG1 or second signal line SIG2 selected by data selector circuit 120.

Power supply 30 supplies power for operating display device 1 to each part of display device 1. Power supply 30 supplies the operating power to, for example, display 11, gate driver 12, data driver 13, and controller 20. Power supply 30 supplies, for example, an initialization voltage, a reference voltage, a positive supply voltage, and a negative supply voltage to display 11.

Gate driver 12 supplies a control signal for controlling the operation of pixels 110 to pixels 110 via control signal lines. Gate driver 12 functions as a scanning line driver circuit. The control signal lines include write signal lines WS, initialization signal lines INI, and reference signal lines REF. Write signal line WS is one example of a gate signal line.

Data driver 13 supplies a data signal corresponding to light emission brightness to pixels 110 via a data signal line. The data signal is a voltage signal based on the display gradation of pixels 110. Data driver 13 drives a circuit element including a light-emitting pixel by outputting a data signal to each of data signal lines via data selector circuit 120 by time division. Data driver 13 functions as a signal line driver circuit. The data signal lines include first signal line SIG1 and second signal line SIG2.

Next, pixels 110 will be described with reference to FIG. 3. FIG. 3 is a circuit diagram illustrating one example of a configuration of pixel 110 according to this embodiment. In other words, FIG. 3 is a circuit diagram illustrating one example of a pixel circuit including pixel 110.

Figure 3:
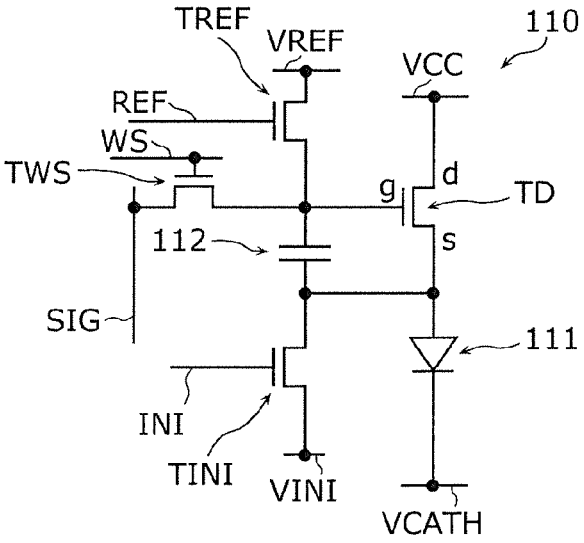
FIG. 3 is a circuit diagram illustrating one example of a configuration of a pixel according to Embodiment 1.

As illustrated in FIG. 3, pixels 110 are each a circuit that causes organic EL element 111 to emit light with luminance corresponding to a data signal, and each of pixels 110 includes organic EL element 111, capacitor element 112, and drive transistor TD. Each of pixels 110 further includes reference transistor TREF, write transistor TWS, and initialization transistor TINI. Reference signal line REF, write signal line WS, and initialization signal line INI, each of which supplies a control signal that is output from gate driver 12, are connected to each of pixels 110. Data signal line SIG (e.g., first signal line SIG1 or second signal line SIG2) that supplies a data signal output from data driver 13 is connected to each of pixels 110.

Organic EL element 111 is a light-emitting element that has a first electrode and a second electrode. In the example illustrated in FIG. 3, the first electrode and the second electrode are an anode and a cathode of organic EL element 111, respectively. The second electrode of organic EL element 111 is connected to cathode power line VCATH. A negative supply voltage is supplied from power supply 30 to cathode power line VCATH. Organic EL element 111 is one example of such a light-emitting element.

Capacitor element 112 is an element for holding a voltage and is connected between gate electrode g and source electrode s of drive transistor TD.

Drive transistor TD is a thin-film transistor that is connected to the first electrode of organic EL element 111 and supplies, to organic EL element 111, a current in accordance with the voltage held by capacitor element 112. Source electrode s of drive transistor TD is connected to the first electrode (anode) of organic EL element 111, and drain electrode d of transistor TD is connected to anode power line VCC. A positive supply voltage is supplied from power supply 30 to anode power line VCC.

Initialization transistor TINI is a thin-film transistor for initializing the potential of the first electrode of organic EL element 111. Initialization power line VINI is connected to one of the drain electrode and the source electrode of initialization transistor TINI, and the first electrode of organic EL element 111 is connected to the other. Initialization signal line INI is connected to the gate electrode of initialization transistor TINT. Initialization transistor TINI becomes on-state according to a voltage supplied to initialization signal line INI and changes the potential of the first electrode of organic EL element 111 to an initialization voltage. It can be also said that initialization transistor TINI becomes on-state according to the voltage supplied to initialization signal line INI and changes the potential of source electrode s of drive transistor TD to an initialization voltage. An initialization voltage for initializing the potential of the first electrode of organic EL element 111 is supplied from power supply 30 to initialization power line VINI.

Reference transistor TREF is a thin-film transistor for applying a reference voltage to capacitor element 112. Reference power line VREF is connected to one of the drain electrode and the source electrode of reference transistor TREF, and gate electrode g of drive transistor TD is connected to the other. Reference signal line REF is connected to the gate electrode of reference transistor TREF. Reference transistor TREF becomes on-state according to a voltage supplied to reference signal line REF and changes the potential of gate electrode g of drive transistor TD to a reference voltage. A reference voltage is supplied from power supply 30 to reference power line VREF.

Write transistor TWS is a thin-film transistor for applying a voltage corresponding to a data signal to capacitor element 112. Data signal line SIG is connected to one of the drain electrode and the source electrode of write transistor TWS, and gate electrode g of drive transistor TD is connected to the other. Write signal line WS is connected to the gate electrode of write transistor TWS. Write transistor TWS becomes on-state according to a write voltage, for example, and causes capacitor element 112 to hold the voltage corresponding to the data signal. A signal that is input to write signal line WS is one example of a gate signal.

1-2. Explanation on Uneven Brightness

Figure 4:
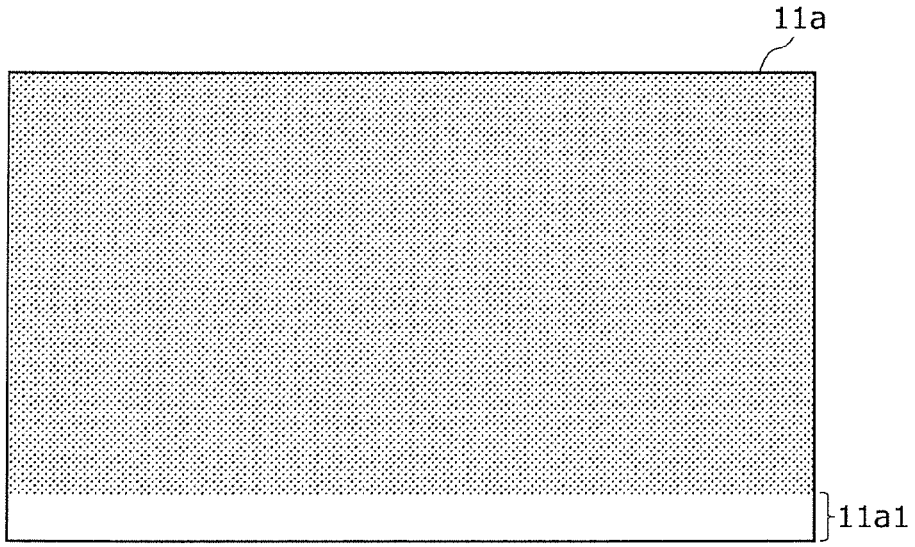
FIG. 4 is a schematic diagram illustrating one example of uneven brightness that occurs in a display according to a comparative example.

The following describes uneven brightness that occurs when an initialization operation of initializing the potential of the first electrode of organic EL element 111 is performed with the use of display device 1 as described above. FIG. 4 is a schematic diagram illustrating one example of uneven brightness that occurs in display 11*a* according to a comparative example. In FIG. 4, the density of dot hatching presents the brightness of an image displayed by display 11*a*. The image is brighter with a decrease in the density of dot hatching. The configuration of a display device according to the comparative example is the same as that of display device 1 and has a selector circuit.

Figure 5:
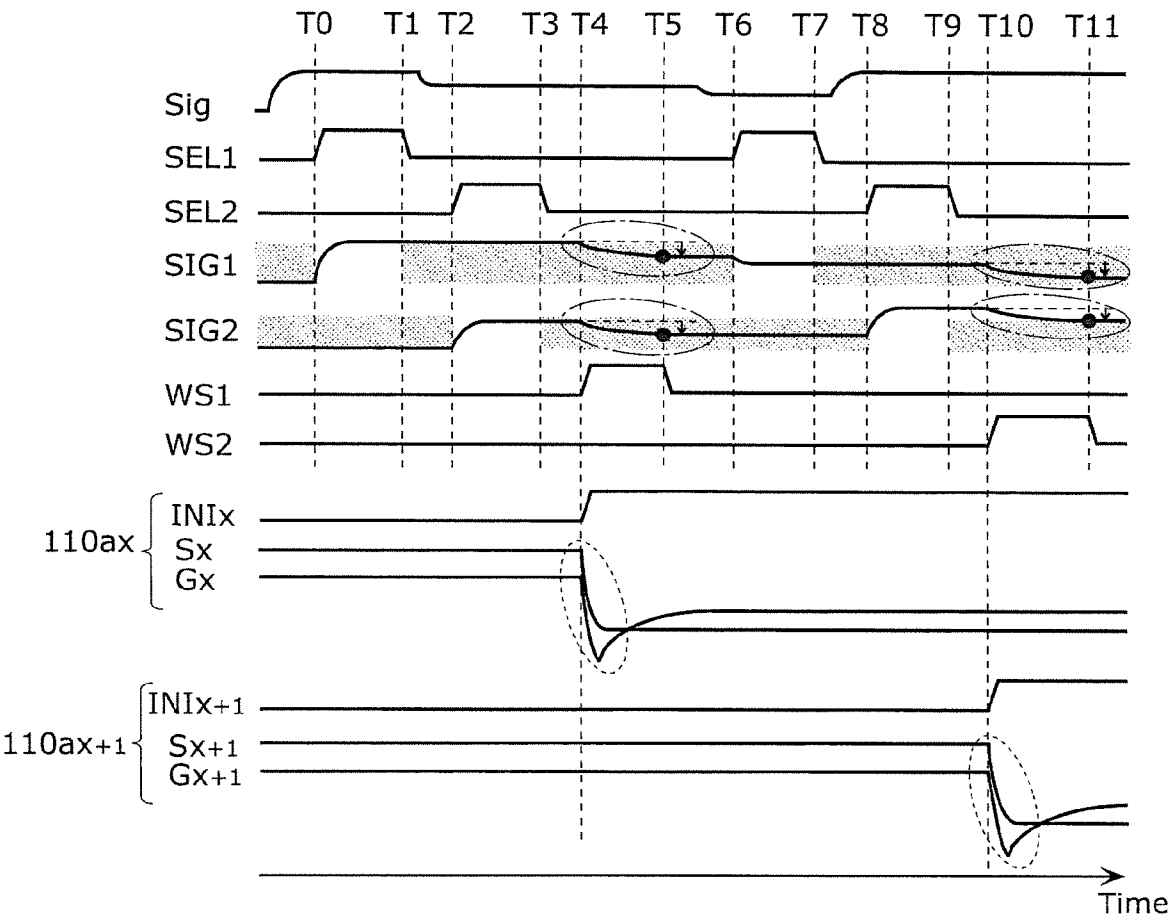
FIG. 5 is a diagram illustrating one example of a drive timing to drive pixels according to the comparative example.

As illustrated in FIG. 4, region 11*a*1 having higher luminance than the other region occurs in the lower part of display 11*a* of the display device. The following describes one of the causes of such uneven brightness with reference to FIG. 5. FIG. 5 is a diagram illustrating one example of a drive timing to drive pixels 110 according to the comparative example. FIG. 5 illustrates, in addition to waveforms of various signals, waveforms of the potentials of gate electrode g and source electrode s of drive transistor TD in each of pixels 110 on which an initialization operation is being performed. The dot-hatched portion in FIG. 5 shows that the potentials of gate electrode g and source electrode s are in a floating state. In FIG. 5, the horizontal axis presents time and the vertical axis presents a signal level.

In FIG. 5, "Sig" denotes a waveform of a data signal (control signal) supplied from controller 20 to data selector circuit 120. "SEL1" denotes a waveform of a signal supplied to first selector control line SEL1 while "SEL2" denotes a waveform of a signal supplied to second selector control line SEL2. "SIG1" denotes a waveform of a data signal supplied to first signal line SIG1 via data selector circuit 120 whereas "SIG2" denotes a waveform of a data signal supplied to second signal line SIG2 via data selector circuit 120. "WS1" denotes a waveform of a signal supplied to write signal line WS1 while "WS2" denotes a waveform of a signal supplied to write signal line WS2.

Moreover, "INIx" in FIG. 5 denotes a waveform of a signal supplied to initialization signal line INI of pixels 110 (e.g., pixel 110*ax* in FIG. 2) on which an initialization operation is performed when a write operation is being performed on pixels 110 (e.g., pixel 110*a*1 in FIG. 2) connected to write signal line WS1. "Sx" and "Gx" in FIG. 5 denote waveforms of the potentials of source electrode s and gate electrode g, respectively, of drive transistor TD in each of pixels 110 on which the initialization operation is being performed. Hereinafter, pixels on which an initialization operation is performed are also referred to as other pixels.

Moreover, "INIx+1" in FIG. 5 denotes a waveform of a signal supplied to initialization signal line INI of other pixels 110 (e.g., pixel 110*ax*+1) when a write operation is being performed on pixels 110 (e.g., pixel 110*a*2) connected to write signal line WS2. "Sx+1" and "Gx+1" in FIG. 5 denote waveforms of the potentials of source electrode s and gate electrode g, respectively, of drive transistor TD in each of pixels 110 on which an initialization operation is being performed.

As illustrated in FIG. 5, the level of a signal that is input to first selector control line SEL1 becomes high firstly at time point T0, and a connection between first signal line SIG1 and data driver 13 becomes a conducting state via data selector circuit 120. With this, a data signal from data driver 13 is output to first signal line SIG1. The data signal here is a voltage signal in accordance with the potential of first signal line SIG1. Then, at time point T1, the level of the signal that is input to first selector control line SEL1 becomes low and the potential of first signal line SIG1 becomes a floating state. It is to be noted that a connection between second signal line SIG2 and data driver 13 is in a non-conducting state during a period from time point T0 to time point T1.

Subsequently, at time point T2, the level of a signal that is input to second selector control line SEL2 becomes high and a connection between second signal line SIG2 and data driver 13 becomes a conducting state via data selector circuit 120. With this, a data signal from data driver 13 is output to second signal line SIG2. The data signal here is a voltage signal in accordance with the potential of second signal line SIG2. Then, at time point T3, the level of the signal that is input to second selector control line SEL2 becomes low and the potential of second signal line SIG2 becomes a floating state. It is to be noted that a connection between first signal line SIG1 and data driver 13 is in a non-conducting state during a period from time point T2 to time point T3.

Subsequently, at time point T4, the level of a signal that is input to write signal line WS1 becomes high and a write operation of holding a voltage corresponding to the data signal, in capacitor element 112 of each of pixels 110 (e.g., pixels 110*a*1 and 110*b*1 in FIG. 2) connected to write signal line WS1, is started. In other words, the write operation is performed when both of first signal line SIG1 and second signal line SIG2 are in a floating state.

Moreover, at time point T4, in order to further perform an initialization operation on pixels 110 connected to write signal line WS different from write signal line WS1, the level of an initialization signal that is input to initialization signal line INI connected to those pixels 110 becomes high. For example, the level of the initialization signal that is input to initialization signal line INI becomes high in each of pixels 110 including pixel 110*ax* and pixel 110*bx* that are connected to write signal line WSx in FIG. 2. With this, a connection between the drain electrode and the source electrode of initialization transistor TINI becomes a conducting state. Accordingly, the potential of the first electrode of organic EL element 111, the potential of source electrode s of drive transistor TD, and the potential of the electrode, which is connected to source electrodes of drive transistor TD, of capacitor element 112 are initialized (see a region enclosed by a dashed oval in FIG. 5). An initial voltage of approximately −3 V is applied to, for example, the first electrode (anode) of organic EL element 111.

Since capacitor element 112 is present between gate electrode g and source electrode s of drive transistor TD, as described above, the potential of gate electrode g may fluctuate as affected by the potential of source electrode s. When pixels 110 (e.g., pixel 110*ax*) on which the initialization operation is performed were emitting light with at least a predetermined brightness, in particular, the fluctuation of the potential of gate electrode g is significant because the potential of source electrode s of drive transistor TD and the potential of the electrode, which is connected to that source electrode s, of capacitor element 112 greatly fluctuate when the initialization operation is performed. Specifically, the potential of gate electrode g also decreases as the potential of source electrode s decreases (see a region enclosed by a dashed oval in FIG. 5).

When the potential of gate electrode g decreases by at least a predetermined amount in pixel 110*ax* on which the initialization operation is performed, write transistor TWS in pixel 110*ax* unintentionally becomes on-state. With this, a potential is supplied from a data signal line that is in a floating state to pixels 110 on which the initialization operation is performed, and the potential of pixels 110 on which the write operation is performed unintentionally becomes lower than the potential originally held. Referring to FIG. 2, for example, pixel value 110*a*1 on which the write operation is performed is electrically connected, via first signal line SIG1, to pixel 110*ax* on which the initialization operation is performed. Therefore, when write transistor TWS in pixel 110*ax* becomes on-state during the write operation performed on pixel 110*a*1, for example, a potential is unintentionally supplied to pixel 110*a*1 from first signal line SIG1 corresponding to pixel 110*a*1 and holding a data signal. The potential of first signal line SIG1 decreases since first signal line SIG1 is in a floating state and no data signal is supplied from power supply 30 (see a region enclosed by a dash-dotted oval in FIG. 5). Likewise, the potential of a data signal supplied to pixel 110*b*1 on which a write operation is performed decreases.

Subsequently, at time point T5, the level of the signal that is input to write signal line WS1 becomes low and the write operation performed on pixels 110 (e.g., pixels 110*a*1 and 110*b*1 in FIG. 2) connected to write signal line WS1 is ended. For the reasons stated above, a data signal having a voltage level lower than that originally held by the data signal is written to pixel 110*a*1 on which the write operation is performed. Therefore, display by that pixel 110*a*1 becomes less bright than original brightness. The period from time point T4 to time point T5 is one example of a period during which a write operation is performed.

The write operation as described above is sequentially performed for each pixel row. For example, a period from time point T6 to time point T11 illustrates the timing charts of various signals for pixels 110 (e.g., pixels 110 including pixels 110*a*2 and 110*b*2) connected to write signal line WS2. Since the operation timings of a write operation and an initialization operation performed in the period from time point T6 to time point T11 are the same as those performed in the period from time point T0 to time point T5, respectively, the description is omitted.

Although not shown in the diagram, the level of a reference signal that is input to reference signal line REF becomes high, for example, at a timing that is after time point T4 and is a timing at which a signal having a high level is input to initialization signal line INIx, and a reference voltage is applied to the electrode connected to gate electrode g of drive transistor TD, for example, in pixel 110*ax* on which the initialization operation is performed. With this, a reference voltage of approximately 1 V is applied to gate electrode g of drive transistor TD, and an initial voltage of approximately −3 V is applied to source electrode s of drive transistor TD. In other words, a voltage of approximately 4 V is applied between gate electrode g and source electrode s of drive transistor TD and also to capacitor element 112. Here, a transistor with a threshold voltage of at most 4 V is used for drive transistor TD. In this case, a current in accordance with a voltage held by capacitor element 112 flows between drain electrode d and source electrode s of drive transistor TD. In such a case, an initial voltage of approximately −3 V is applied to the anode of organic EL element 111 via initialization transistor TINI whereas a cathode voltage (negative supply voltage) of approximately +1.5 V is applied to the cathode of organic EL element 111 via cathode power line VCATH. In other words, since a backward bias is applied to organic EL element 111, organic EL element 111 does not emit light. A current flowing through drive transistor TD flows into capacitor element 112 and is used for threshold compensation operation.

FIG. 6A, FIG. 6B, FIG. 6C, and FIG. 6D are each a schematic diagram illustrating the locations, at time points t=ta, t=tb., t=tc, or t=td in display 11*a* of the display device according to the comparative example, of a row including pixels 110 on which a write operation is performed and a row including other pixels 110. In FIG. 6A through FIG. 6D, each of rows R1*a* through R1*d* denotes a pixel row including pixels 110 on which a write operation is performed, and each of rows R2*a* through R2*c* denotes a pixel row including other pixels 110.

Figure 6A:
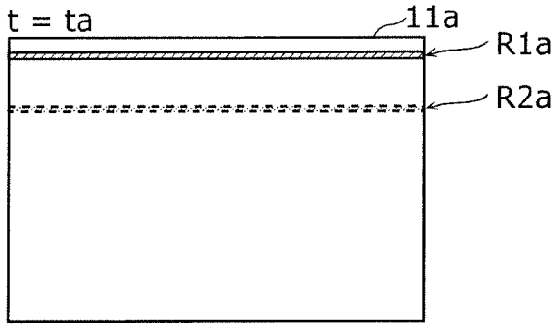
FIG. 6A is a schematic diagram illustrating the locations, at time point t=ta in the display of a display device according to the comparative example, of a row including pixels on which a write operation is performed and a row including pixels on which an initialization operation is performed.
Figure 6B:
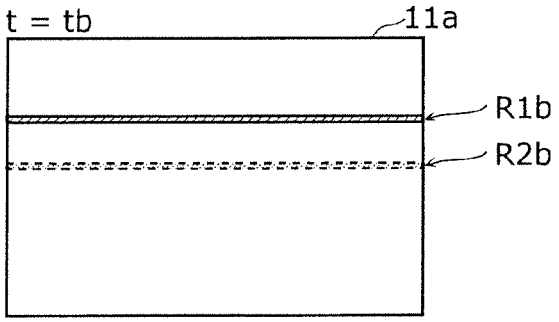
FIG. 6B is a schematic diagram illustrating the locations, at time point t=tb in the display of the display device according to the comparative example, of a row including pixels on which a write operation is performed and a row including pixels on which an initialization operation is performed.
Figure 6C:
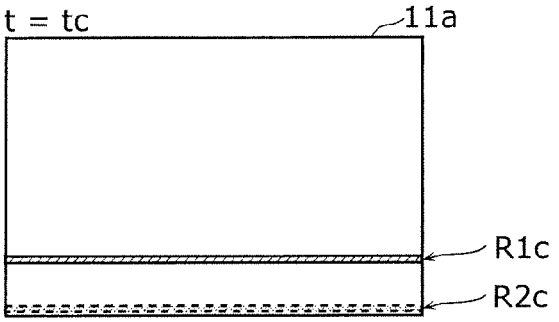
FIG. 6C is a schematic diagram illustrating the locations, at time point t=tc in the display of the display device according to the comparative example, of a row including pixels on which a write operation is performed and a row including pixels on which an initialization operation is performed.

As illustrated in FIG. 6A through FIG. 6C, until time point t=tc, an initialization operation is performed on other pixels 110 (in rows R2*a* through R2*c*) when a write operation is performed on pixels 110. The potential of a data signal supplied to pixels 110 on which the write operation is performed until time point t=tc is lower than the potential originally held by the data signal (see a region enclosed by a dash-dotted oval in FIG. 5) since the write operation on those pixels 110 is performed in parallel with the initialization operation performed on other pixels 110. Therefore, until time point t=tc, the luminance of organic EL element 111 is lower than luminance corresponding to the data signal output by data driver 13. The potential originally held by the data signal is the potential of the data signal supplied from data driver 13 to pixels 110 on which the write operation is performed.

In contrast, at a time point after time point t=tc, an initialization operation is not performed since a pixel row including other pixels 110 enters a blanking period when a write operation is performed on pixels 110. Thus, at a time point after time point t=tc, there is no such factor that decreases the potential of gate electrode g of drive transistor TD in each of other pixels 110 when the write operation is performed. Therefore, a potential is not supplied to other pixels 110. Accordingly, the data signal supplied to pixels 110 on which the write operation is performed at a time point after time point t=tc has the potential originally held by the data signal. Therefore, at a time point after time point t=tc, the luminance of organic EL element 111 becomes the luminance of the data signal output by data driver 13.

Due to the occurrence of the phenomenon as described above, region 11*a*1 having luminance higher than that of the other region occurs in the lower part of display 11*a*.

Figure 7:
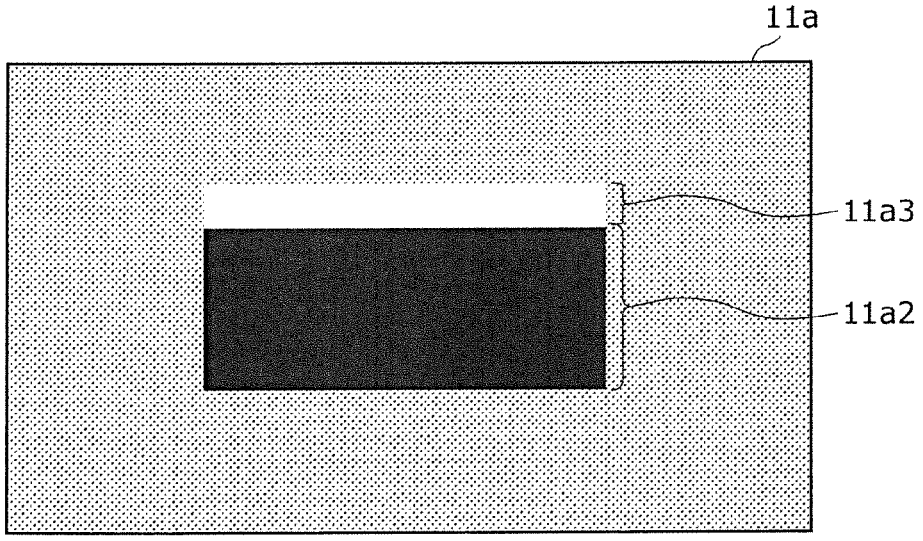
FIG. 7 is a schematic diagram illustrating another example of uneven brightness that occurs in the display according to a comparative example.
Figure 8:
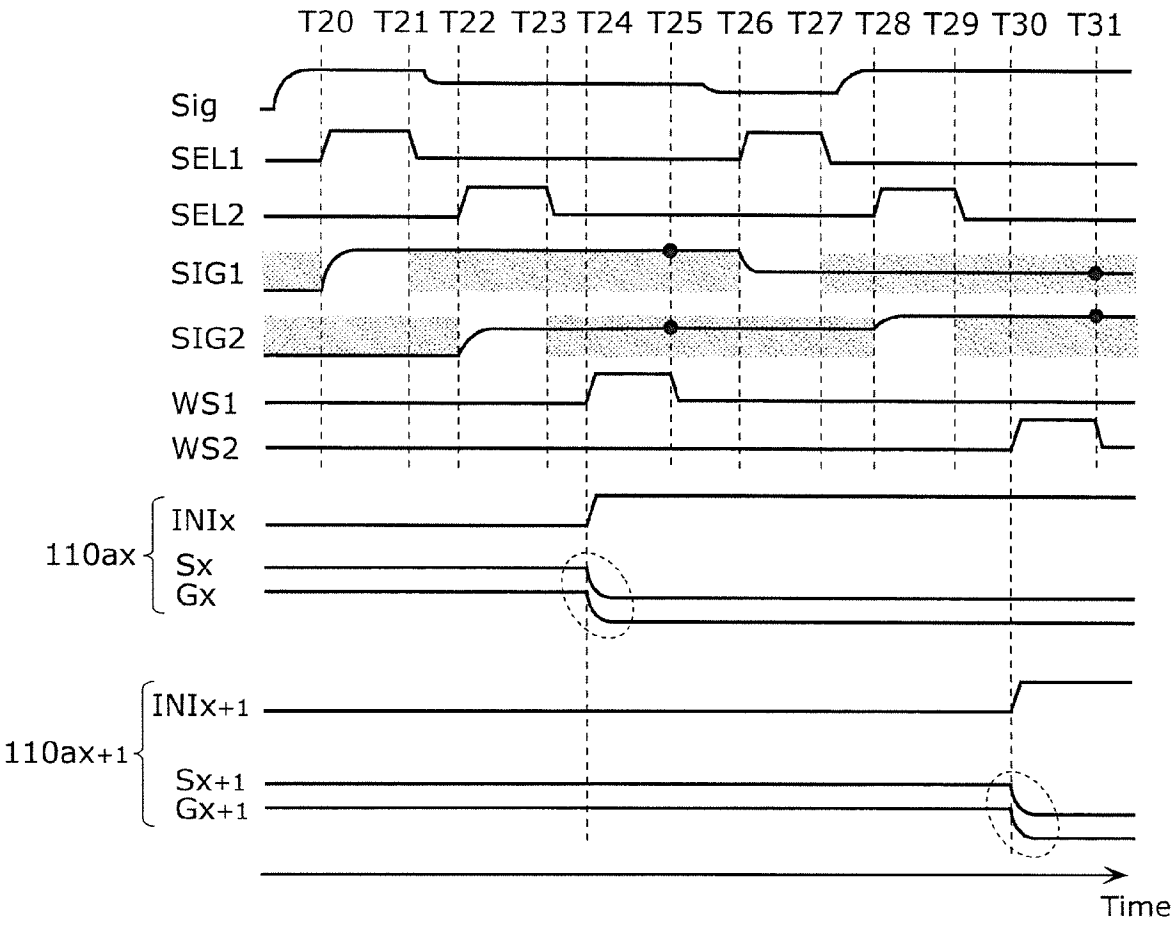
FIG. 8 is a diagram illustrating another example of a drive timing to drive pixels according to the comparative example.

The following describes, with reference to FIG. 7 and FIG. 8, another example of uneven brightness that occurs in display 11*a* according to a comparative example. FIG. 7 is a schematic diagram illustrating another example of uneven brightness that occurs in display 11*a* according to the comparative example.

In display 11*a* of the display device, region 11*a*3 having luminance higher than that of the other region occurs above region 11*a*2 that displays a black screen, as illustrated in FIG. 7. The display of a black screen means display with luminance having a predetermined value or lower. One of the causes of such uneven brightness will be described with reference to FIG. 8. FIG. 8 is a diagram illustrating another example of a drive timing to drive pixels according to the comparative example. FIG. 8 illustrates, in addition to waveforms of various signals, waveforms of the potentials of gate electrode g and source electrode s of drive transistor TD in each of pixels 110 on which an initialization operation is being performed. FIG. 8 describes the case where other pixels 110 were displaying a black screen. Moreover, the operations performed in a period from time point T20 to time point T31 are the same as those performed in the period from time point T0 to time point T11, respectively, the description is omitted.

At time point T24, the level of a signal that is input to write signal line WS1 becomes high and a write operation of holding a voltage corresponding to a data signal, in capacitor element 112 in each of pixels 110 (e.g., pixels 110*a*1 and 110*b*1 in FIG. 2), is started, as illustrated in FIG. 8.

Moreover, at time point T24, in order to further perform an initialization operation on pixels 110 connected to write signal line WS different from write signal line WS1, the level of an initialization signal that is input to initialization signal line INI connected to those pixels 110 becomes high. For example, the level of the initialization signal that is input to initialization signal line INI becomes high in each of pixels 110 including pixels 110*ax* and 110*bx* that are connected to write signal line WSx in FIG. 2. With this, a connection between the drain electrode and the source electrode of initialization transistor TINI becomes a conducting state. Accordingly, the potential of the first electrode of organic EL element 111, the potential of source electrode s of drive transistor TD, and the potential of the electrode, which is connected to source electrode s of drive transistor TD, of capacitor element 112 are initialized (see a region enclosed by a dashed oval in FIG. 8).

Since capacitor element 112 is present between gate electrode g and source electrode s of drive transistor TD, as described above, the potential of gate electrode g may fluctuate as affected by the potential of source electrode s. In the case where other pixels 110 were displaying a black screen, however, since the potential of source electrode s of drive transistor TD and the potential of the electrode, which is connected to source electrode s of drive transistor TD, of capacitor element 112 are low from the beginning, these potentials fluctuate less even when an initialization operation is performed. The fluctuation in this case is smaller than the case where other pixels 110 were displaying a bright screen, for example. The voltage fluctuation of gate electrode g of drive transistor TD brought by the potential of source electrode s is therefore small (see a region enclosed by a dashed oval in FIG. 8).

In this case, since a decrease in the potential of gate electrode g is small in each of other pixels 110, write transistor TWS does not become on-state. With this, a data signal output from data driver 13 is supplied to pixels 110 on which a write operation is performed. Stated differently, a data signal whose potential has not decreased is supplied to pixels 110 on which the write operation is performed. Accordingly, the luminance of organic EL element 111 in each of pixels 110 on which the write operation is performed is the luminance of the data signal output by data driver 13. Thus, in the case where other pixels 110 were displaying a black screen, pixels 110 on which a write operation is performed are capable of performing display with original luminance.

Figure 6D:
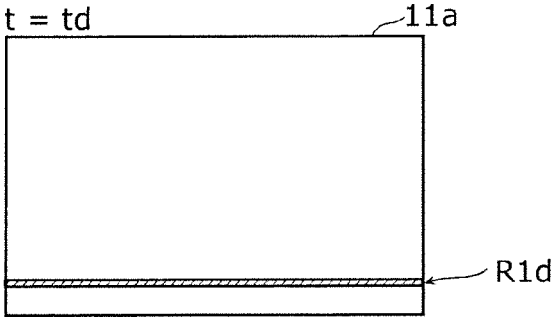
FIG. 6D is a schematic diagram illustrating the location, at time point t=td in the display of the display device according to the comparative example, of a row including pixels on which a write operation is performed.

In the case where other pixels 110 were displaying a bright screen, however, write transistors TWS in those pixels 110 unintentionally become on-state when an initialization operation is performed, as described with reference to FIG. 5 through FIG. 6D. With this, pixels 110 on which a write operation is performed perform display with luminance lower than original luminance. The term "bright" used herein means brightness corresponding to the potential of source electrode s of drive transistor TD and the potential of the electrode, which is connected to source electrode s of drive transistor TD, of capacitor element 112. The potentials are such that write transistor TWS in each of pixels 110 unintentionally becomes on-state when the initialization operation is performed.

As described above, the potential of a data signal supplied to pixels 110 on which a write operation is performed may vary in accordance with the brightness of other pixels 110 (specifically, the potential of the first electrode of organic EL element 111). A difference in the potential of the data signal appears as a difference in the brightness of pixels 110 on which the write operation is performed, that is, uneven brightness.

Figure 9A:
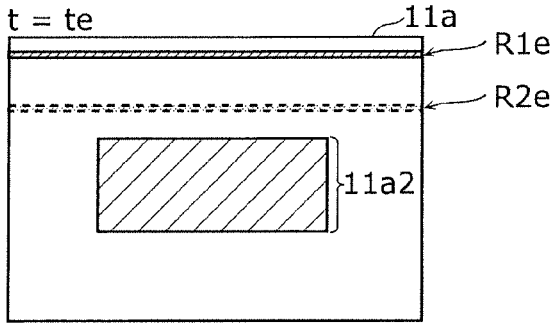
FIG. 9A is a schematic diagram illustrating the locations, at time point t=te in the display of the display device according to the comparative example, of a row including pixels on which a write operation is performed and a row including pixels on which an initialization operation is performed.
Figure 9B:
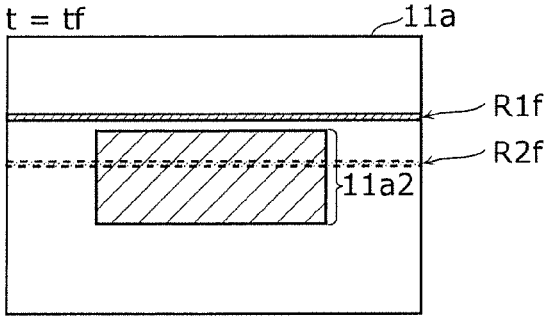
FIG. 9B is a schematic diagram illustrating the locations, at time point t=tf in the display of the display device according to the comparative example, of a row including pixels on which a write operation is performed and a row including pixels on which an initialization operation is performed.
Figure 9C:
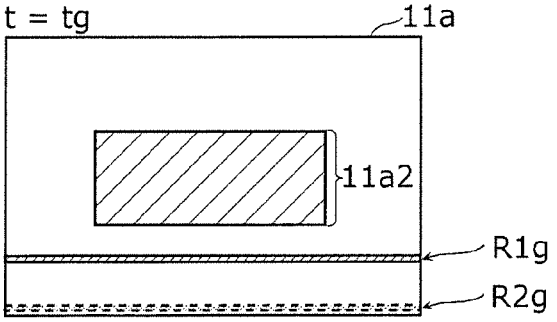
FIG. 9C is a schematic diagram illustrating the locations, at time point t=tg in the display of the display device according to the comparative example, of a row including pixels on which a write operation is performed and a row including pixels on which an initialization operation is performed.

FIG. 9A, FIG. 9B, and FIG. 9C are each a schematic diagram illustrating the locations, at time points t=te, t=tf, or t=tg in display 11*a* of the display device according to the comparative example, of a row including pixels 110 on which a write operation is performed and a row including other pixels 110. In FIG. 9A through FIG. 9C, each of rows R1*e* through R1*g* denotes a pixel row including pixels 110 on which a write operation is performed and each of rows R2*e* through R2*g* denotes a pixel row including other pixels 110.

At time point t=te or t=tg, an initialization operation is performed on other pixels 110 (row R2*e* or R2*g*) when a write operation is performed on pixels 110, as illustrated in FIG. 9A or FIG. 9C. Since other pixels 110 were not displaying a black screen, the potential of a data signal supplied to pixels 110 on which the write operation is performed becomes lower than the potential originally held by the data signal. The potential originally held by the data signal means the potential of the data signal supplied from data driver 13 to pixels 110 on which the write operation is performed.

In contrast, at time point t=tf, since other pixels 110 (in row R2*f*) were displaying a black screen when a write operation is performed on pixels 110, the potential of the data signal supplied to pixels 110 on which the write operation is performed becomes the potential originally held by the data signal. Therefore, the luminance of organic EL element 111 in each of pixels 110 (portion of row R1*f*) becomes brighter than the luminance of organic EL element 111 in each of pixels 110 (in row R1*e* or row R1*g*).

With the occurrence of such a phenomenon as described above, region 11*a*3 having luminance higher than that of the other region occurs above region 11*a*2 that displays a black screen on display 11*a*, as illustrated in FIG. 7.

1-3. Control for Inhibiting Uneven Brightness

Figure 10:
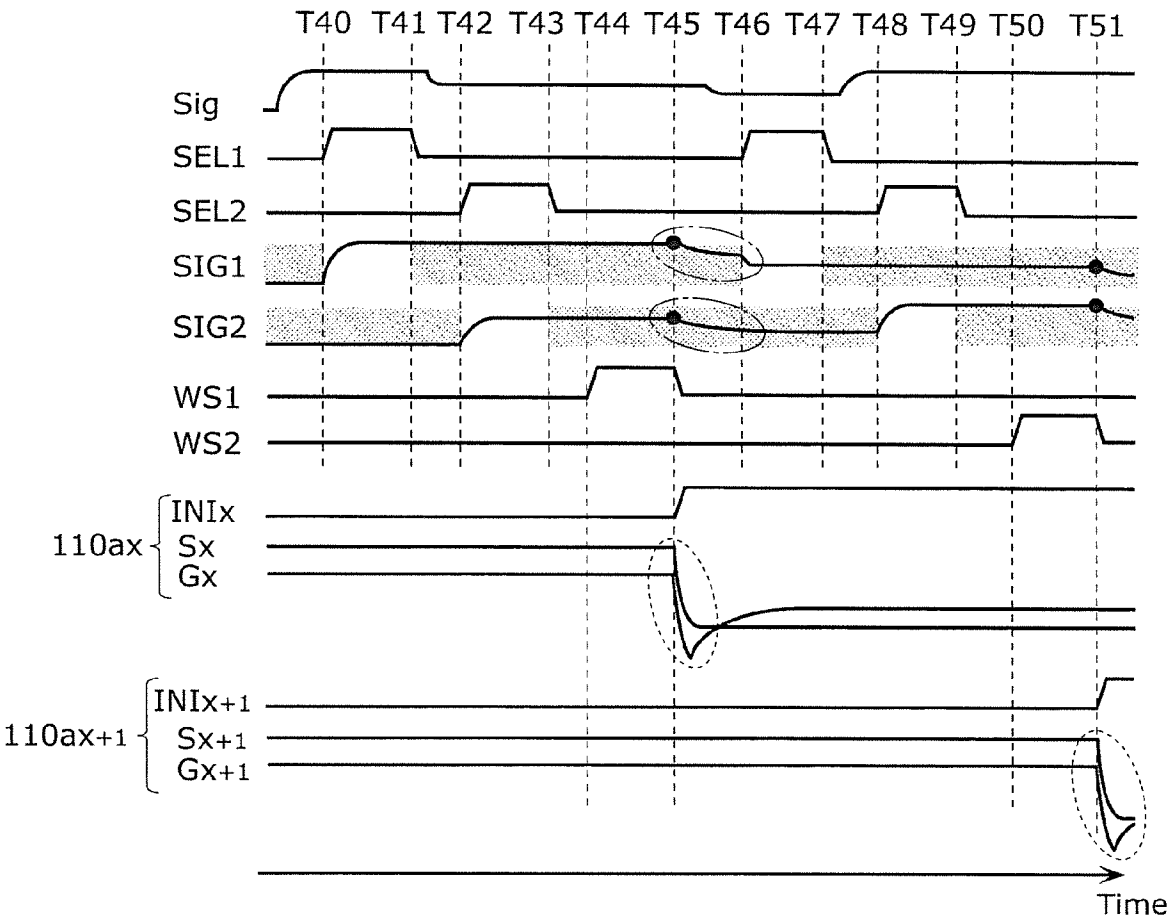
FIG. 10 is a diagram illustrating one example of a drive timing to drive pixels according to Embodiment 1.

In view of this, display device 1 according to this embodiment has an object to reduce uneven brightness as described above. FIG. 10 is a diagram illustrating one example of a drive timing to drive pixels 110 according to this embodiment. Note that the operations performed in a period from time point T40 to time point T43 are the same as those performed in the period from time point T0 to T3, respectively, the description is omitted.

As illustrated in FIG. 10, at time point T44, the level of a signal that is input to write signal line WS1 becomes high and a write operation of holding a voltage corresponding to a data signal, in capacitor element 112 in each of pixels 110 (e.g., pixels 110*a*1 and 110*b*1 in FIG. 2) connected to write signal line WS1, is started. This is the same operation as that performed at time point T4 in FIG. 5.

In this embodiment, the level of an initialization signal that is input to initialization signal line INI of other pixels 110 stays low at time point T44. In other words, in display device 1 according to this embodiment, a write operation and an initialization operation are not performed in parallel.

Subsequently, at time point T45, the level of the signal that is input to write signal line WS1 becomes low and the write operation on pixels 110 (e.g., pixels 110*a*1 and 110*b*1 in FIG. 2) connected to write signal line WS1 is ended. With this, since the potential of the data signal is not supplied to other pixels 110, the original data signal is supplied to pixels 110 on which the write operation is performed.

In this embodiment, at time point T45, in order to perform an initialization operation on pixels 110 (other pixels) connected to write signal line WS different from write signal line WS1, the level of the initialization signal that is input to initialization signal line INI connected to those pixels 110 becomes high. For example, the level of the initialization signal that is input to initialization signal line INI becomes high in each of pixels 110 including pixels 110*ax* and 110*bx* that are connected to write signal line WSx in FIG. 2. With this, a connection between the drain electrode and the source electrode of initialization transistor TINI becomes a conducting state. Accordingly, the potential of the first electrode of organic EL element 111, the potential of source electrode s of drive transistor TD, and the potential of the electrode, which is connected to source electrode s of drive transistor TD, of capacitor element 112 are initialized (see a region enclosed by a dashed oval in FIG. 10). An initial voltage of approximately −3 V is applied to, for example, the first electrode (anode) of organic EL element 111.

As is the case in the respective comparative examples, write transistor TWS unintentionally becomes on-state in each of pixels 110 on which the initialization operation is performed and the potential of the data signal held by the data signal line decreases (see a region enclosed by a dash-dotted oval in FIG. 10). However, the write operation performed on pixels 110 is ended (write transistor TWS in each of pixels 110 on which the write operation is performed is in off-state) at the timing when the potential of data signal line SIG decreases. Therefore, a data signal whose potential has been decreased will not be supplied to those pixels 110. Accordingly, organic EL element 111 in each of pixels 110 on which the write operation is performed has luminance corresponding to the luminance of the data signal output by data driver 13. In other words, organic EL element 111 in each of those pixels 110 is capable of performing display with original luminance.

As described above, by merely changing a timing to start an initialization operation, display device 1 according to this embodiment is capable of reducing uneven brightness without changing a circuit configuration.

It is desirable that a timing to raise the level of an initialization signal input to initialization signal line INI, that is, a timing to turn on initialization transistor TINI be later than a timing (time point T45) at which write transistor TWS in each of pixels 110 on which a write operation is performed becomes off-state. In other words, it is desirable that the initialization operation performed on other pixels 110 (e.g., pixel 110*ax* and so on in FIG. 2) be performed after the write operation on pixels 110 (e.g., pixel 110*a*1 and so on in FIG. 2) is ended. A timing to turn on initialization transistor TINI may be immediately after a timing at which write transistor TWS is turned off. In other words, the initialization operation may be started immediately after a period during which the write operation is performed (a period from time point T 44 to time point T 45 in FIG. 10). The term "immediately after" may mean a moment when write transistor TWS in each of pixels 110 on which the write operation is performed is turned off or may include a certain delay from that moment.

The timing to turn on initialization transistor TINI may be timing after a predetermined period has elapsed since the timing at which write transistor TWS is turned off.

The predetermined period may be determined based on a time required for the potential of gate electrode g in each of other pixels 110 to rise to the potential at which write transistor TWS becomes off-state before the signal that is input to write signal line WS2 becomes high and a write operation on pixels 110 connected to write signal line WS2 is started. Other pixels 110 here are pixels 110 (pixels 110 in the second pixel row) on which an initialization operation is performed after a write operation is performed on pixels 110 (pixels 110 in the first pixel row) before a write operation is performed on pixels 110 (pixels 110 in the third pixel row)

connected to write signal line WS2. In each of other pixels 110, since the potential of gate electrode g of drive transistor TD decreases by the initialization operation being performed, write transistor TWS in each of those other pixels 110 becomes on-state, but the potential of gate electrode g rises with the elapse of time. Then, when the potential of gate electrode g rises to the potential at which write transistor TWS becomes off-state, write transistor TWS becomes off-state.

Therefore, when a period from when the initialization operation performed on other pixels 110 is started until when write transistor TWS in each of other pixels 110 becomes off-state is defined as a third period and a period between the time when the write operation on pixels 110 in the first pixel row is ended and the time until a data signal is supplied to pixels 110 in the second pixel row is defined as a fourth period, a predetermined period may be at most a period obtained by subtracting the third period from the fourth period. The third period may be, for example, a period from time point T45 to time point T 48. The fourth period may be, for example, a period from when the write operation on pixels 110 in the first pixel row is ended until when a write operation on pixels 110 in the second pixel row is started (e.g., a period from time point T45 to time point 50).

Thus, the predetermined period may be determined so that the period during which write transistor TWS is in on-state in each of other pixels 110 does not overlap any of write periods of pixels 110 other than those other pixels 110.

The predetermined period may be determined according to capacitance between gate electrode g and source electrode s of drive transistor TD (e.g., capacitance of capacitor element 112), for instance.

Although not shown in FIG. 10, in a period during which write transistor TWS is in on-state, reference transistor TREF is in off-state.

Therefore, drive transistor TD does not become on-state when a write operation is performed. Accordingly, with display device 1, it is possible to reduce uneven brightness without generating a through current flowing from anode power line VCC to initialization power line VINI.

The write operation as described above is sequentially performed for each pixel row. For example, in a period from time point T46 to time point T51 in FIG. 10, operation timings for pixels 110 (e.g., pixels 110 including pixels 110*a*2 and 110*b*2) connected to write signal line WS2 are illustrated. The operation timings of a write operation and an initialization operation in the period from time point T46 to time point T51 are the same as those performed in the period from time point 40 to time point T45, respectively, and the description is omitted.

Controller 20 controls gate driver 12 and data driver 13 so that a write operation and an initialization operation are performed at the timings as described above.

1-4. Advantageous Effects Etc.

As described above, display device 1 according to the present embodiment includes: a plurality of pixels 110 arranged in a matrix in rows and columns; a plurality of write signal lines WS, each of which is disposed for a different one of pixel rows, for selecting a pixel row to which a data voltage for image data is to be written, the pixel rows including a first pixel row and a second pixel row that are mutually different and are included in the plurality of pixels; gate driver 12 that supplies a gate signal to the plurality of write signal lines WS; a plurality of data signal lines SIG, each of which is disposed for a different one of pixel columns, for writing the data voltage; data driver 13 that supplies the data voltage to the plurality of data signal lines SIG; data selector circuit 120 that supplies, per at least one data signal line SIG by time division, the data voltage from data driver 13, the at least one data signal line SIG being included in the plurality of data signal lines SIG; and controller 20 that controls gate driver 12 and data driver 13. Each of the plurality of pixels 110 includes: light-emitting element 11 including a first electrode and a second electrode; capacitor element 112 for holding a voltage; and drive transistor TD that is connected to the first electrode of light-emitting element 111 and supplies a current in accordance with the voltage held by capacitor element 112 to light-emitting element 111. Controller 20 causes gate driver 12 and data driver 13 to perform an initialization operation of initializing a potential of the first electrode of light-emitting element 111 in each of pixels 110 included in the second pixel row, after a period during which a write operation of writing the data voltage to pixels 110 included in the first pixel row is performed.

This can inhibit write transistor TWS in each of pixels 110 in the second pixel row from becoming on-state in a period during which a write operation is being performed on pixels 110 in the first pixel row. In other words, it is possible to inhibit the supply of the potential of the data signal to pixels 110 in the second pixel row. Accordingly, display device 1 is capable of reducing uneven brightness.

For example, display device 1 is a display device including data selector circuit 120, and each of data signal lines SIG becomes a floating state when a data voltage is written. With such display device 1, by performing an initialization operation on other pixels 110 after a write operation is performed on pixels 110, it is possible to inhibit a decrease in the potential of the data voltage caused by other pixels 110 when the write operation is performed, thereby reducing uneven brightness.

Moreover, each of the plurality of pixels 110 includes write transistor TWS connected between gate electrode g of drive transistor TD and a corresponding one of the plurality of data signal lines SIG. The plurality of pixels 110 include a third pixel row on which the write operation is performed after the write operation is performed on the first pixel row, the third pixel row being different from the first pixel row and the second pixel row. Controller 20 causes gate driver 12 and data driver 13 to start the initialization operation on the second pixel row at a timing when the write transistor is turned off before a start of the write operation performed on the third pixel row, after the write transistor in each of pixels 110 included in the second pixel row is turned on by the initialization operation performed on the second pixel row.

With this, the potential of gate electrode g of drive transistor TD in each of pixels 110 in the second pixel row rises to the potential at which write transistor TWS becomes off-state, at a time point when a data signal is supplied to pixels 110 in the third pixel row. In other words, since write transistor TWS in each of pixels 110 in the second pixel row is in off-state at the time point when the data signal is supplied to pixels 110 in the third pixel row, the potential of the data signal supplied to pixels 110 in the third pixel row does not easily decrease due to pixels 110 in the second pixel row. Accordingly, display device 1 is capable of reducing uneven brightness even more.

Moreover, controller 20 causes gate driver 12 and data driver 13 to start the initialization operation on the second pixel row immediately after the period during which the write operation is performed on the first pixel row.

With this, the period from when the initialization operation on pixels 110 in the second pixel row is started until when a data signal is supplied to pixels 110 in the third pixel row becomes longer. In other words, since the potential of gate electrode g of drive transistor TD in each of pixels 110 in the second pixel row easily rises to the potential at which write transistor TWS in each of those pixels 110 becomes off-state, it is possible to inhibit a decrease, due to pixels 110 in the second pixel row, in the potential of the data signal supplied to pixels 110 in the third pixel row. Accordingly, display device 1 is capable of reducing uneven brightness even more.

Moreover, the light-emitting element is organic EL element 111.

This can reduce uneven brightness in display device 1 including organic EL elements 111.

Embodiment 2

The following describes a display device according to this embodiment with reference to the drawings. The display device according to this embodiment is characterized by a timing at which reference transistor TREF is turned on in each of pixels 110 on which an initialization operation is performed.

Note that the following description focuses on differences between this embodiment and Embodiment 1. The elements identical to those described in Embodiment 1 are assigned with the same reference signs, and the description may be omitted or simplified in some cases. The configuration of the display device according to this embodiment is the same as that of display device 1 according to Embodiment 1, and the description is omitted.

2-1. Control for Inhibiting Uneven Brightness

Figure 11:
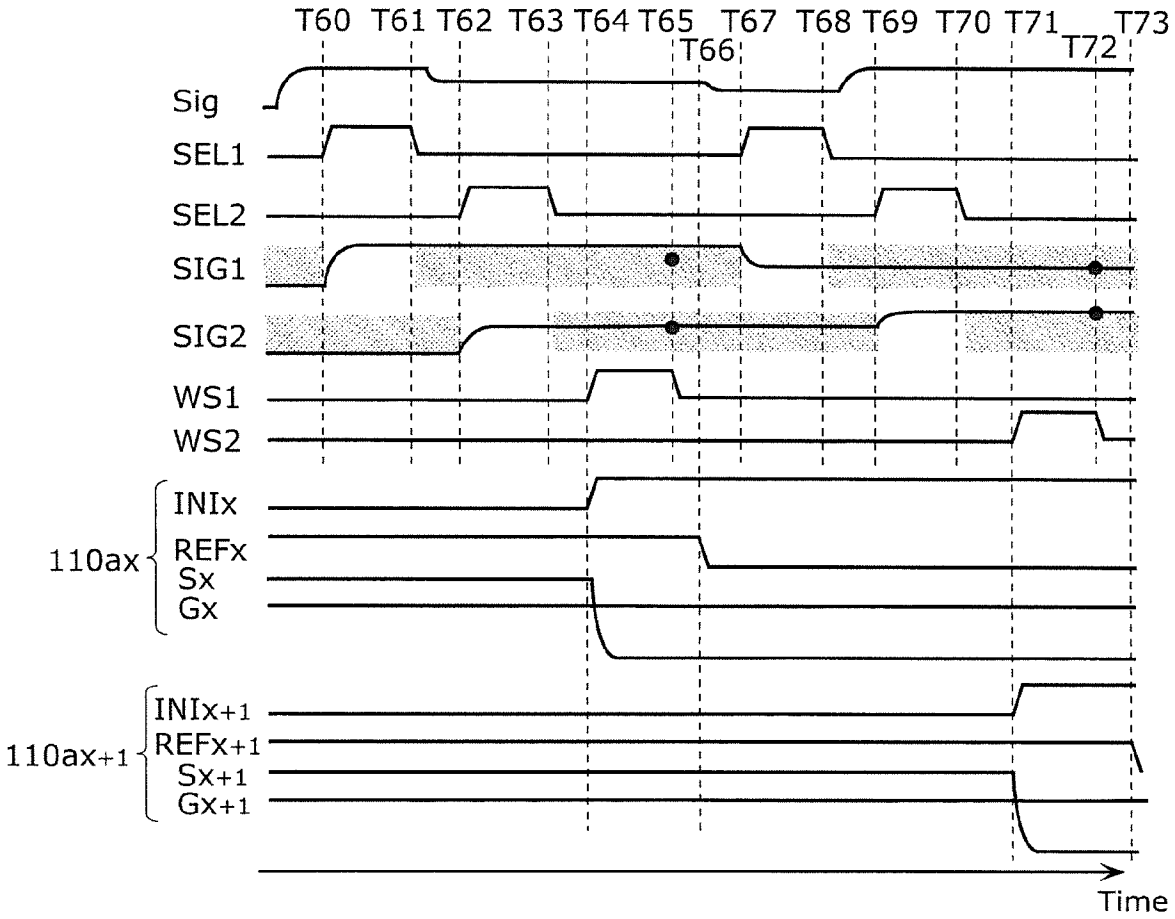
FIG. 11 is a diagram illustrating one example of a drive timing to drive pixels according to Embodiment 2.

FIG. 11 is a diagram illustrating one example of a drive timing to drive pixels 110 according to this embodiment. In FIG. 11, "REFx" presents a waveform of a signal supplied to reference signal line REF of pixels 110 (e.g., pixel 110*ax*) on which an initialization operation is performed when a write operation is being performed on pixels 110 (e.g., pixel 110*a*1) connected to write signal line WS1. Moreover, "REFx+1" presents a waveform of a signal supplied to reference signal line REF of pixels 110 (e.g., pixel 110*ax*+1) on which an initialization operation is performed when a write operation is being performed on pixels 110 (e.g., pixel 110*a*2) connected to write signal line WS2.

At time point T60, the level of a signal that is input to first selector control line SEL1 becomes high and a connection between first signal line SIG1 and data driver 13 becomes a conducting state. This is the same operation as that performed at time point T40 illustrated in FIG. 10.

In this embodiment, at time point T60, the level of a signal that is input to reference signal line REF of pixels 110 on which an initialization operation is performed also becomes high and reference transistor TREF is in on-state. In other words, the potential of gate electrode g of drive transistor TD comes to indicate a reference voltage supplied from reference power line VREF. A timing at which the level of the signal that is input to reference signal line REF becomes high may be, for example, before data driver 13 outputs a data signal to a data signal line connected to pixels 110 on which a write operation is performed.

The operations performed in a period from time point T61 to time point T63 are the same as those performed in the period from time point T41 to time point T43 illustrated in FIG. 10, respectively, and the description is omitted. Note that reference transistor TREF is continuously in on-state over the period from time point T61 to time point T63. In other words, reference transistor TREF is in on-state while the data signal is output from data driver 13 to first signal line SIG1 or second signal line SIG2. It can be also said that reference transistor TREF is in on-state when data selector circuit 120 allows a conducting state between data driver 13 and either first signal line SIG1 or second signal line SIG2.

Subsequently, at time point T64, the level of a signal that is input to write signal line WS1 becomes high and a write operation of holding a voltage corresponding to a data signal, in capacitor element 112 in each of pixels 110 (e.g., pixels 110*a*1 and 110*b*1 in FIG. 2) connected to write signal line WS1, is started. Furthermore, in order to perform an initialization operation on pixels 110 connected to write signal line WS different from write signal line WS1, the level of an initialization signal that is input to initialization signal line INI connected to those pixels 110 is set at a high level at time point T64. In other words, the write operation and the initialization operation are performed in parallel.

Although the potential of source electrode s of drive transistor TD in pixel 110*ax* on which the initialization operation is performed decreases, the potential of gate electrode g of drive transistor TD does not fluctuate because a reference voltage is supplied. In other words, the potential of gate electrode g of drive transistor TD is constant irrespective of the fluctuation of the potential of source electrode s of drive transistor TD. Stated differently, the potential of gate electrode g of drive transistor TD is constant before and after the initialization operation.

Subsequently, at time point T65, the level of the signal that is input to write signal line WS1 becomes low and the write operation on pixels 110 (e.g., pixels 110*a*1 and 110*b*1 in FIG. 2) connected to write signal line WS1 is ended. Here, reference transistor TREF remains to be in on-state. Note that the period from time point T64 to time point T65 is one example of the first period.

Subsequently, at time point T66, the level of the signal that is input to reference signal line REF becomes low and reference transistor TREF becomes off-state. The timing at which the signal input to reference signal line REF becomes low, that is, the timing to turn off reference transistor TREF may be any time after write transistor TWS in each of pixels 110 on which the write operation is performed becomes off-state. In other words, the timing at which the level of the signal that is input to reference signal line REF becomes low may be any time after the write operation on pixels 110 is ended. The timing may be immediately after write transistor TWS has become off-state or after a predetermined period has elapsed since the timing at which write transistor TWS becomes off-state.

This can reduce uneven brightness irrespective of capacitance between gate electrode g and source electrode s of drive transistor TD since it is possible to keep the potential of gate electrode g of drive transistor TD to be constant while an initialization operation is being performed.

The period during which reference transistor TREF in pixel 110*ax* is turned on may be a period including a period from a time point when the level of an initialization signal that is input to initialization signal line INIx becomes high until a time point when the level of a signal that is input to write signal line WS1 becomes low. The period is, for example, a period that includes a period from time point T64 to time point T65 illustrated in FIG. 11. The period during which reference transistor TREF in pixel 110*ax* is turned on may be a period including a period from the time point when the level of the initialization signal that is input to initialization signal line INIx becomes high until a time point when potential Sx of source electrode s of drive transistor TD comes to indicate an initial voltage supplied from initialization power line VINI. The period is, for example, a period including a period from time point T64 to a time point when potential Sx becomes constant (a time point between time point T64 and time point T65) as illustrated in FIG. 11.

It can be also said that the period during which reference transistor TREF in pixel 110*ax* is turned on is a period (the first period) during which the write operation is performed on pixel 110*a*1 or a period including a period until the initialization operation on pixel 110*ax* is substantially completed. That the initialization operation is substantially completed means that potential Sx of source electrode s of drive transistor TD comes to indicate an initial voltage and potential Sx no longer changes even when initialization transistor TINI is in on-state.

In view of this, it is desirable that the timing to turn on reference transistor TREF in pixel 110*ax* is at or before the time point when the level of the initialization signal that is input to initialization signal line INIx becomes high. It is also desirable that the timing at which reference transistor TREF in pixel 110*ax* is turned off is at a first time point when the level of the signal that is input to write signal line WS1 becomes low or a second time point when potential Sx of source electrode s of drive transistor TD comes to indicate an initial voltage. Note that the timing at which reference transistor TREF in pixel 110*ax* is turned off may be the earlier time point between the first time point and the second time point. In the example illustrated in FIG. 11, the timing at which reference transistor TREF in pixel 110*ax* is turned off may be the second time point (a time point between time point T64 and time point T65). Controller 20 may determine whether potential Sx has come to indicate the initial voltage, for example, by obtaining potential Sx from a sensor that measures potential Sx of source electrode s or by determining whether a predetermined time has elapsed since the time point when the level of the initialization signal input to initialization signal line INIx became high.

Note that a period including the period from time point T64 to time point T65 is one example of the second period. In the example illustrated in FIG. 11, the first period is as long as the second period. The second period is not limited to have a length equal to that of the first period, and may have any length permitted that the second period includes a period from the start point of an initialization operation to the end point of the first period.

The write operation as described above is sequentially performed for each pixel row. For example, from time point T67 to time point T73 in FIG. 11, operation timings for pixels 110 (e.g., pixels 110 including pixels 110*a*2 and 110*b*2) connected to write signal line WS2 are illustrated. The operation timings of a write operation and an initialization operation in the period from time point T67 to time point T73 are the same as those in the period from time point 60 to time point T66, respectively, and the description is omitted.

It should be noted that the period during which the level of the signal that is input to reference signal line REF is high, that is, the period during which reference transistor TREF is turned on is not limited to the example illustrated in FIG. 11. The period may include at least a period during which a write operation is performed (e.g., a period during which the level of the signal that is input to write signal line WS is high).

2-2. Advantageous Effects Etc.

As described above, display device 1 according to this embodiment includes: a plurality of pixels 110 arranged in a matrix in rows and columns; a plurality of write signal lines WS (one example of a gate signal line), each of which is disposed for a different one of pixel rows, for selecting a pixel row to which a data voltage for image data is to be written, the pixel rows including a first pixel row and a second pixel row that are mutually different and are included in the plurality of pixels; gate driver 12 that supplies a gate signal to the plurality of write signal lines WS; a plurality of data signal lines SIG, each of which is disposed for a different one of pixel columns, for writing a data voltage for image data; data driver 13 that supplies the data voltage to the plurality of data signal lines SIG; data selector circuit 120 that supplies, per at least one data signal line SIG by time division, the data voltage from data driver 13, the at least one data signal line SIG being included in the plurality of data signal lines SIG; and controller 120 that controls gate driver 12 and data driver 13. Each of the plurality of pixels 110 includes: light-emitting element 111 that includes a first electrode and a second electrode; capacitor element 112 for holding a voltage; drive transistor TD that is connected to the first electrode of light-emitting element 111 and supplies a current in accordance with the voltage held by capacitor element 112 to light-emitting element 111, reference power line VREF to which a reference voltage is applied; reference transistor TREF connected between reference power line VREF and gate electrode g of drive transistor TD; and write transistor TWS connected between gate electrode g of drive transistor TD and data signal line SIG connected to pixel 110. Controller 20 causes gate driver 12 and data driver 13 to (i) perform an initialization operation of initializing a potential of the first electrode of light-emitting element 111 in each of pixels 110 included in the second pixel row in a first period during which a write operation of writing the data voltage to pixels included in the first pixel row is performed and (ii) turn on the reference transistor TREF before a start point of the initialization operation.

Since this keeps the potential of gate electrode g of drive transistor TD in each of pixels 110 in the second pixel row to be constant, write transistor TWS in each of those pixels 110 does not become on-state even though an initialization operation is performed on pixels 110 in the second pixel row in a period during which a write operation is being performed on pixels 110 in the first pixel row. In other words, since write transistor TWS in each of pixels 110 in the second pixel row is in off-state in the period during which the write operation is performed on pixels 110 in the first pixel row, the potential of the data signal supplied to pixels 110 in the first pixel row does not easily decrease due to pixels 110 in the second pixel row. Accordingly, display device 1 is capable of reducing uneven brightness even more.

Performing the initialization operation in the first period means that at least a portion of a period during which the initialization operation is performed needs to overlap the first period.

Moreover, controller 20 may cause gate driver 12 and data driver 13 to turn off reference transistor TREF at an end point of the first period.

This can inhibit a through current flowing from anode power line VCC to initialization power line VINI from continuously flowing even after a write operation.

Moreover, controller 20 may cause gate driver 12 and data driver 13 to turn off reference transistor TREF at a time point when the potential of the first electrode becomes an initial potential.

This can inhibit a through current flowing from anode power line VCC to initialization power line VINI from continuously flowing even after an initialization operation is substantially completed.

Moreover, controller 20 may cause gate driver 12 and data driver 13 to turn off reference transistor TREF at the earlier time point between a first time point which is an end point of the first period and a second time point at which the potential of the first electrode becomes an initial potential.

This can further inhibit a through current flowing from anode power line VCC to initialization power line VINI.

Other Embodiments

Forms obtained by various modifications to foregoing embodiments that can be conceived by a person skilled in the art as well as forms realized by arbitrarily combining structural components and functions in the embodiments within the scope of the essence of the present disclosure are included in the present disclosure.

Figure 12:
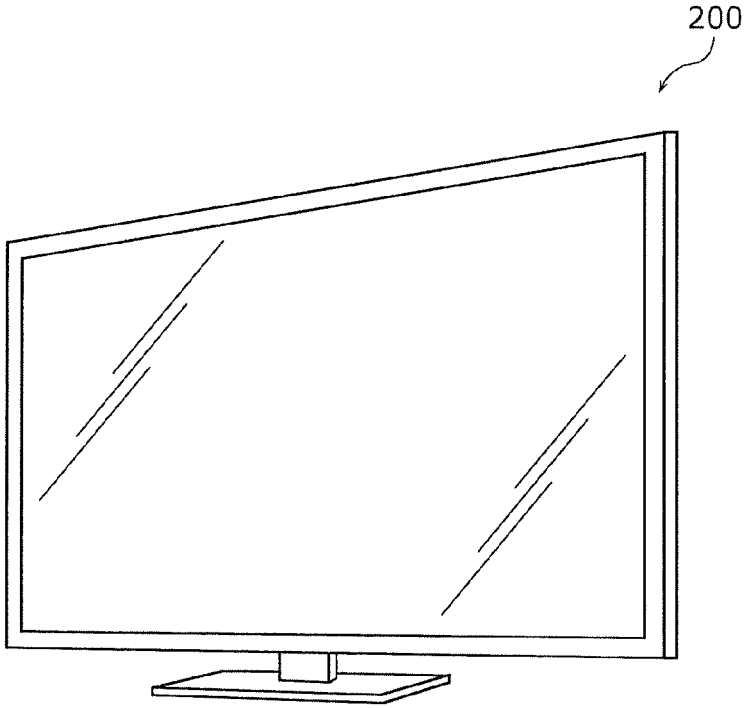
FIG. 12 is a diagram illustrating an outer appearance of a thin display device according to other embodiments.

Display device 1 according to the present disclosure may be realized as, for example, thin display device 200 as illustrated in FIG. 12. FIG. 12 is a diagram illustrating an outer appearance of thin display device 200. Such thin display device 200 is capable of reducing uneven brightness more than a conventional display device when an initialization operation is performed.

Although each of the aforementioned embodiments has described an example of the case where light-emitting elements included in display device 1 are organic EL elements 111, the light-emitting elements are not limited to this. The light-emitting elements may be any other light-emitting elements of self-luminous type and may be, for example, light-emitting elements using quantum-dot light-emitting diodes (QLEDs).

Moreover, one aspect of the present disclosure may be realized as a drive method of driving display device 1 described above. Display device 1 includes: a plurality of pixels 110 arranged in a matrix in rows and columns; a plurality of write signal lines WS (one example of gate signal lines), each of which is disposed for a different one of pixel rows including a first pixel row and a second pixel row that are mutually different and are included in the plurality of pixels 110, for selecting a pixel row to which a data voltage for image data is to be written; gate driver 12 that supplies a gate signal to the plurality of write signal lines WS; a plurality of data signal lines SIG, each of which is disposed for a different one of pixel columns, for writing the data voltage for image data; data driver 13 that supplies the data voltage to the plurality of data signal lines SIG; and data selector circuit 120 that supplies, per at least one data signal line SIG by time division, the data voltage from data driver 13, wherein at least one data signal line SIG is included in the plurality of data signal lines SIG.

For example, each of the plurality of pixels 110 includes: organic EL element 111 that includes a first electrode and a second electrode; capacitor element 112 for holding a voltage; drive transistor TD that is connected to the first electrode of organic EL element 111 and supplies a current in accordance with the voltage held by capacitor element 112 to organic EL element 111. The method of driving display device 1 includes causing gate driver 12 and data driver 13 to perform an initialization operation of initializing the potential of the first electrode of organic EL element 111 in each of pixels 110 in the second pixel row after the period during which a write operation of writing a data voltage to pixels 110 in the first pixel row is performed.

For example, each of the plurality of pixels 110 includes: organic EL element 111 including a first electrode and a second electrode; capacitor element 112 for holding a voltage; drive transistor TD that is connected to the first electrode of organic EL element 111 and supplies a current in accordance with the voltage held by capacitor 112 to organic EL element 111; reference power line VREF to which a reference voltage is applied; reference transistor TREF connected between reference power line VREF and gate electrode g of drive transistor TD; and write transistor TWS connected between gate electrode g of drive transistor TD and data signal line SIG connected to pixel 110. The method of driving display device 1 includes causing gate driver 12 and data driver 13 to (i) perform an initialization operation of initializing the potential of the first electrode of organic EL element 111 in each of pixels 110 included in the second pixel row, in a first period during which a write operation of writing the data voltage to pixels 110 in the first pixel row is performed and (ii) continuously turn on reference transistor TREF over a second period including the start point of the initialization operation and the end point of the first period.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is useful, for example, for flat panel displays using organic EL elements.

The invention claimed is:

1. A display device, comprising:

a plurality of pixels arranged in a matrix in rows and columns;

a plurality of gate signal lines, each of which is disposed for a different one of pixel rows, for selecting a pixel row to which a data voltage for image data is to be written, the pixel rows including a first pixel row and a second pixel row that are mutually different and are included in the plurality of pixels;

a gate driver that supplies a gate signal to the plurality of gate signal lines;

a plurality of data signal lines, each of which is disposed for a different one of pixel columns, for writing the data voltage;

a data driver that supplies the data voltage to the plurality of data signal lines;

a data selector circuit that supplies, per at least one data signal line by time division, the data voltage from the data driver, the at least one data signal line being included in the plurality of data signal lines; and a controller that controls the gate driver and the data driver, wherein each of the plurality of pixels includes:

a light-emitting element including a first electrode and a second electrode;

a capacitor element for holding a voltage; and a drive transistor that is connected to the first electrode of the light-emitting element and supplies a current in accordance with the voltage held by the capacitor element to the light-emitting element, the controller causes the gate driver and the data driver to perform an initialization operation of initializing a potential of the first electrode of the light-emitting element in each of pixels included in the second pixel row, after a write operation of writing the data voltage to pixels included in the first pixel row is performed, the initialization operation and the write operation are performed during an uninterrupted period, the initialization operation is performed during a second portion of the uninterrupted period, the second portion of the uninterrupted period being continuous with and after a first portion of the uninterrupted period in which the write operation is performed, and the initialization operation, which is performed in each of the pixels included in the second pixel row, and the write operation, which is performed in the pixels included in the first pixel row, are not performed in parallel, with the initialization operation, which is performed in each of the pixels included in the second pixel row, being started before a write operation of an immediately preceding row in the matrix.

2. The display device according to claim 1, wherein each of the plurality of pixels includes a write transistor connected between a gate electrode of the drive transistor and a corresponding one of the plurality of gate signal lines, the plurality of pixels include a third pixel row on which the write operation is performed after the write operation is performed on the first pixel row, the third pixel row being different from the first pixel row and the second pixel row, and the controller causes the gate driver and the data driver to start the initialization operation on the second pixel row at a timing when the write transistor is turned off before a start of the write operation performed on the third pixel row, after the write transistor in each of the pixels included in the second pixel row is turned on by the initialization operation performed on the second pixel row.

3. The display device according to claim 1, wherein the controller causes the gate driver and the data driver to start the initialization operation on the second pixel row immediately after the first portion of the uninterrupted period during which the write operation is performed on the first pixel row.

4. The display device according to claim 1, wherein the light-emitting element is an organic electroluminescent (EL) element.

5. A display device, comprising:

a plurality of pixels arranged in a matrix in rows and columns;

a plurality of gate signal lines, each of which is disposed for a different one of pixel rows, for selecting a pixel row to which a data voltage for image data is to be written, the pixel rows including a first pixel row and a second pixel row that are mutually different and are included in the plurality of pixels;

a gate driver that supplies a gate signal to the plurality of gate signal lines;

a plurality of data signal lines, each of which is disposed for a different one of pixel columns, for writing a data voltage for image data;

a data driver that supplies the data voltage to the plurality of data signal lines;

a data selector circuit that supplies, per at least one data signal line by time division, the data voltage from the data driver, the at least one data signal line being included in the plurality of data signal lines; and a controller that controls the gate driver and the data driver, wherein each of the plurality of pixels includes:

a light-emitting element that includes a first electrode and a second electrode;

a capacitor element for holding a voltage;

a drive transistor that is connected to the first electrode of the light-emitting element and supplies a current in accordance with the voltage held by the capacitor element to the light-emitting element;

a reference power line to which a reference voltage is applied;

a reference transistor connected between the reference power line and a gate electrode of the drive transistor; and a write transistor connected between the gate electrode of the drive transistor and the data signal line connected to the pixel, the controller causes the gate driver and the data driver to: (i) perform a write operation of writing the data voltage to pixels included in the first pixel row during a first period; (ii) perform an initialization operation of initializing a potential of the first electrode of the light-emitting element in each of pixels included in the second pixel row during a second period, with the second period overlapping with the first period during which the write operation is performed; (iii) turn on the reference transistor in each of the pixels included in the second pixel row before a start point of the initialization operation; and (iv) turn off the reference transistor in each of the pixels included in the second pixel row after an end point of the write operation, and the reference transistor directly interconnects the reference power line, the gate electrode of the drive transistor, and the capacitor element.

6. The display device according to claim 5, wherein the controller causes the gate driver and the data driver to turn off the reference transistor at the end point of the first period.

7. The display device according to claim 5, wherein the controller causes the gate driver and the data driver to turn off the reference transistor at a time point when the potential of the first electrode becomes an initial potential.

8. The display device according to claim 5, wherein the controller causes the gate driver and the data driver to turn off the reference transistor at an earlier time point between a first time point which is the end point of the first period and a second time point at which the potential of the first electrode becomes an initial potential.

9. The display device according to claim 5, wherein the light-emitting element is an organic electroluminescent (EL) element.

* * * * *